US005686689A

United States Patent [19]

Snedeker et al.

[11] Patent Number: 5,686,689

[45] Date of Patent: Nov. 11, 1997

[54] LIGHTWEIGHT COMPOSITE ARMOR

[75] Inventors: Richard S. Snedeker, Cranbury; Ross M. Contiliano, East Windsor, both of N.J.; Coleman duP. Donaldson, Gloucester, Va.

[73] Assignee: Aeronautical Research Associates of Princeton, Inc., Princeton, N.J.

[21] Appl. No.: 754,932

[22] Filed: May 17, 1985

[51] Int. Cl.[6] ..... F41H 1/02

[52] U.S. Cl. ..... 89/36.02; 89/36.11

[58] Field of Search ..... 89/36.02, 36.11; 109/78, 80, 82, 84; 428/911

[56] References Cited

U.S. PATENT DOCUMENTS

| | | | |
|---|---|---|---|
| 1,215,727 | 2/1917 | Slattery | 109/82 |
| 3,324,768 | 6/1967 | Eichelberger | 89/36.02 |
| 3,616,115 | 10/1971 | Klimmek | 89/36.02 |
| 3,715,999 | 2/1973 | Shwayder | 109/82 |
| 3,793,648 | 2/1974 | Dorre et al. | 89/36.02 |
| 3,874,855 | 4/1975 | Legrand | 109/84 |

FOREIGN PATENT DOCUMENTS

| | | | |
|---|---|---|---|
| 70689 | 6/1959 | France | 89/36.02 |

*Primary Examiner*—Michael J. Carone
*Assistant Examiner*—Matthew J. Lattig
*Attorney, Agent, or Firm*—Larson & Taylor

[57] ABSTRACT

A lightweight composite armor including an integrally formed matrix block is disclosed. The matrix block includes a generally planar back, a plurality of intersecting ridges extending from the front of the planar back, and fillets provided at the junctures between the planar back and the ridges and at the juncture between the ridges. The matrix block thus forms a pattern of open topped cells. An energy absorbing ceramic body is located in each cell. Individual front plates sized to fit in the open top of each associated cell in mating contact with the ceramic body and provided with upstanding flanges around the periphery thereof are also provided. A weld around the periphery of the front plates between the flanges and associated tops of the ridges is provided. In this manner, impact by a projectile on one of these front plates substantially limits any damage to that one front plate and the underlying ceramic body leaving the remaining armor substantially undamaged. In accordance with the preferred embodiment, each ceramic body includes a concave surface adjacent the mating front plate. In addition, small gaps which exist between the cells and the ceramic bodies are filled with a ceramic-based grout. A polymer impregnated fabric is also provided at the rear of the planar back as desired. Ridges at the planar back can also be provided for stiffening the planar back.

21 Claims, 2 Drawing Sheets

LIGHTWEIGHT COMPOSITE ARMOR

FIELD OF THE INVENTION

The present invention relates generally to ballistic armor, and more particularly to a lightweight composite armor.

BACKGROUND OF THE INVENTION

It has been demonstrated that certain ceramic materials have a high energy absorbing capability in comparison with more conventional materials such as metals. Moreover, since ceramics have lower densities than many metals, their use can be advantageous when light weight is a goal of the armor design. For these reasons, a number of ceramic armor designs have been disclosed in the prior art.

For example, in U.S. Pat. No. 3,431,818 (King), lightweight protective armor plates are disclosed including a composite armor plate having a metallic backing plate to which square plate members or tiles made of a ceramic material are attached. The tiles are arranged in a matrix pattern. In U.S. Pat. No. 3,616,115 (Klimmek), another lightweight composite armor plate including successive layers of small discrete ceramic blocks is disclosed. The blocks are encapsulated within a metal matrix by solid state diffusion bonding so that residual stress effects from the bonding step prestress the blocks in compression to make the blocks more shatter resistant. A composite shock resisting body which is inwardly formed around ceramic blocks laid out in a matrix pattern is also disclosed in U.S. Pat. No. 3,874,855 (Legrand).

Disclosed in U.S. Pat. No. 3,859,892 (Coes) is a composite ceramic armor which includes a laminated fiberglass backing. When the ceramic fails after being struck by a projectile, the laminated glass cloth backing dissipates the energy delivered to protect personnel behind the armor. The backing is preferably extended over the edge of the plate to provide extra protection along the free edge of the plate. In U S. Pat. No. 3,592,952 (Hauck), a composite ceramic armor including a ceramic tile which is attached to a backing element having side lips or flanges is disclosed.

In U.S. Pat. No. 3,924,038 (McArdle et al), a ballistic shield including a blanket portion is disclosed. A plurality of ceramic tiles are bonded to the blanket portion around the fronts of the tiles and a metal backing plate is provided along the backs of the tiles. The general attachment of ceramic tiles having a backing of glass fibers for use as a surface covering for a wall or the like using a suitable mastic or other cement is disclosed in U.S. Pat. No. 2,878,666 (Drummond).

A rigid armor wall element having an impact surface provided with alternate peaks and valleys is also disclosed in U.S. Pat. No. 3,636,895 (Kelsey). The wall element includes integral reinforcing means such as ribs which extend outwardly from the front of the wall.

SUMMARY OF THE INVENTION

In accordance with the present invention, a lightweight composite armor is provided. The armor includes an integrally formed matrix block which has a generally planar back and a plurality of intersecting ridges extending from a front side of the planar back. The ridges terminate in a top and form a matrix of open-topped cells in the matrix block. An energy absorbing ceramic body is located in each cell. The ceramic body serves as a primary energy-absorbent for the armor as each ceramic body is maintained in the associated cell. Individual front plates close the open top of each associated cell in mating contact with the ceramic body. An attaching means is provided for attaching each front plate to the tops of adjacent ridges of the cells around the periphery of the front plates. When impacted by a projectile on one of the front plates, any damage is substantially limited to that one front plate and the underlying ceramic body leaving the remaining armor substantially undamaged.

Depending on the application, the ceramic body is made either integrally formed or from at least two pieces. The ceramic body can also be made of an alumina ceramic or a hot-pressed silicon carbide ceramic. Also depending upon the application, the matrix block and front plate can be formed of an aluminum alloy or of a hard steel alloy.

In the preferred embodiment, fillets are provided at the juncture between the planar back and the ridges as well as at the juncture between the ridges. In addition, the front plates preferably include an upstanding flange around the periphery thereof so that the attaching means attaches the flanges of the front plates to the ridges. Conveniently, the attaching means is a weld.

Where small gaps exist between the cells and the ceramic bodies located therein, a ceramic-based grout is also preferably located in these gaps to fill these gaps. In addition, the ceramic body preferably also includes a recessed surface, such as a concave surface, adjacent the mating front plate. This induces particles resulting from an impact to follow a path away from the front plate to localize any damage in the area of the associated cells.

If desired, a momentum trap means can be attached to the rear side of the planar back for trapping spall ejected from the planar back as a result of a projectile impact on the armor. Preferably, the momemtum trap is a layer of a flexible material, such as a polymer impregnated woven fabric. The rear side of the planar back can also be provided with stiffening ridges to increase the strength of the planar back if desired.

It is an advantage of the present invention that a very robust armor is provided.

It is also an advantage of the present invention that a weight efficient armor is provided.

It is a further advantage of the present invention that multiple hits can be sustained by the armor with damage limited to the specific hit areas.

Other features and advantages of the present invention are stated in or apparent from a detailed description of presently preferred embodiments of the invention found hereinbelow.

DETAILED DESCRIPTION OF THE PREFERRED EMBODIMENTS

Figure 1:
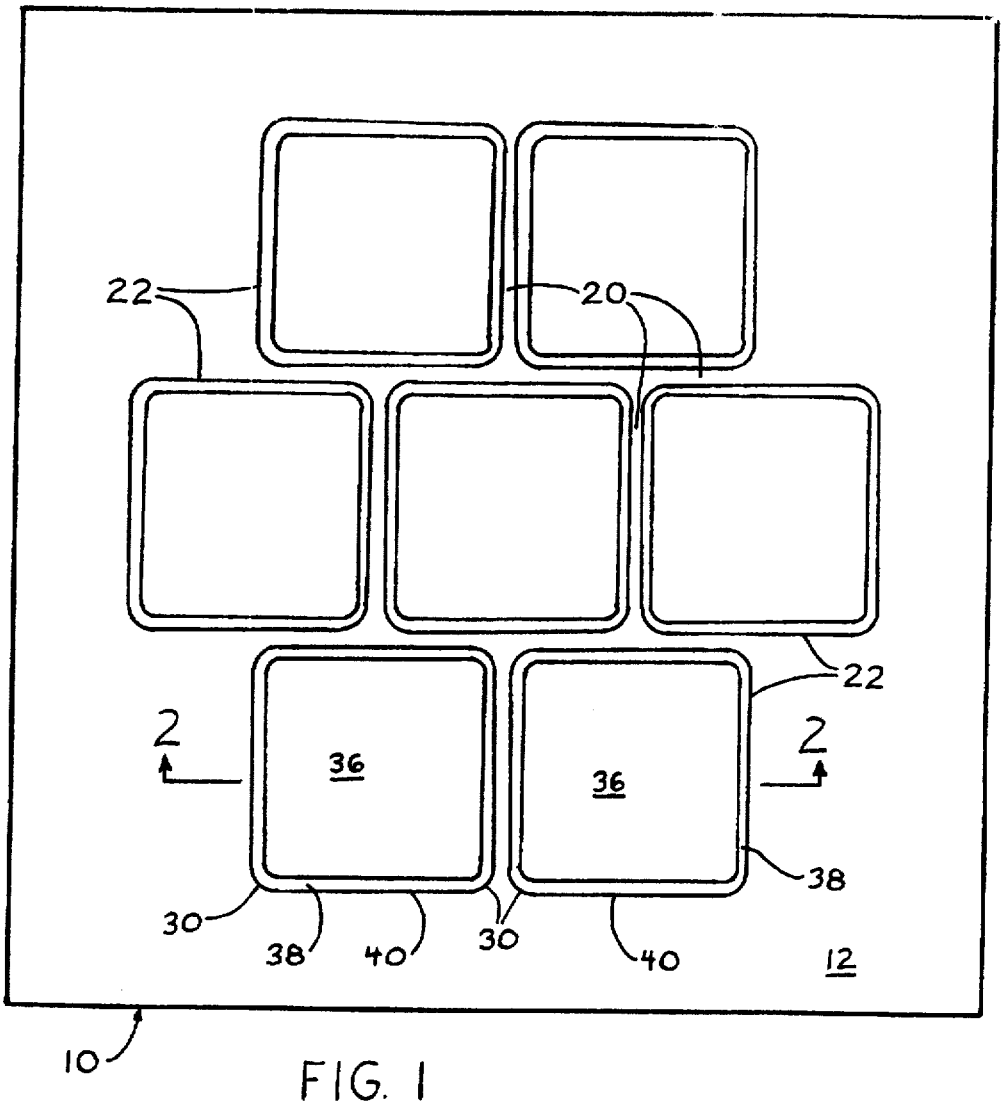
FIG. 1 is a top plan view of a composite armor according to the present invention.
Figure 2:
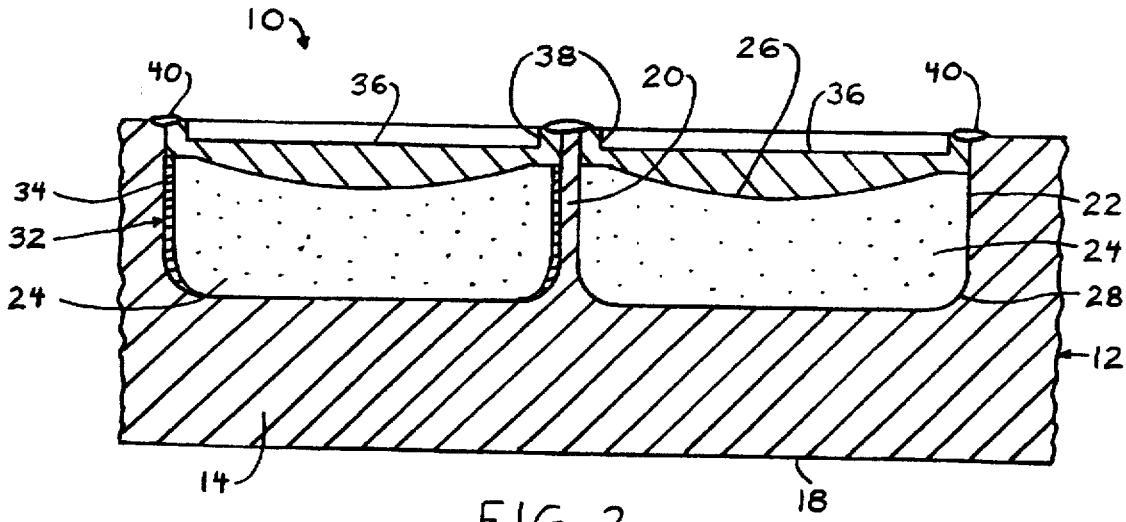
FIG. 2 is a cross-sectional side elevation view of the armor depicted in FIG. 1 taken along the line 2—2.

With reference now to the drawings in which like numerals represent like elements throughout the several views, a lightweight composite armor 10 is depicted in FIGS. 1 and 2. Composite armor 10 includes a matrix block 12. Matrix block 12 is formed of a suitable metal, such as an aluminum alloy or a hard steel alloy. Matrix block 12 includes a generally planar back 14 having a front 16 and a rear 18. Upstanding from front 16 is a plurality of intersecting ridges 20 which are integrally formed with planar back 14. As shown, intersecting ridges 20 form a pattern of open-topped cells 22.

Located in each cell 22 is a ceramic body 24. Ceramic materials have been shown to have a high energy absorbing capability in comparison with more conventional materials such as metals. In addition, ceramics have lower densities than many metals, so that their use can be advantageous when light weight is a goal of the armor design. In order to take maximum advantage of the energy absorbing capability of the ceramic, it is a specific feature of the present invention that each ceramic body 24 is confined to a specific cell 22. In this manner, each ceramic body 24 is held in place so that upon impact by a projectile, that ceramic body 24 absorbs the kinetic energy of the projectile with little or no damage to the adjacent ridges 20 and planar back 14 and hence without damage to the rest of armor 10.

As shown best in FIG. 2, each ceramic body 24 preferably includes a recessed front such as concave front surface 26. Concave front surface 26 induces particles resulting from impact to follow a path away from the front surface so that these particles do not cause severe damage to an adjacent cell 22 of armor 10. Preferably, ceramic bodies 24 are made of an alumina ceramic or a hot-pressed silicon carbide ceramic depending on the particular application of armor 10.

Matrix block 12 also includes fillets 28 located at the intersection of planar back 14 and ridges 20. In addition, fillets 30 are also provided at the intersection of ridges 20. It should be appreciated that ceramic body 24 is designed to fit matingly in cells 22. However, if gaps 32 unavoidably exist between cells 22 and the associated ceramic body 24, a ceramic-based grout 34 such as Sauereisen cement is provided in gaps 32. This provides ceramic body 24 with a tight fit in the associated cell 22. It should be appreciated that the tight fit of ceramic body 24 in cell 22 maximizes the energy absorbing capabilities of ceramic body 24.

Located above each ceramic body 24 in each cell 22 is a front plate 36. As shown best in FIG. 2, front plate 36 has a rear surface which matingly abuts concave front surface 26 of ceramic body 24. In addition, front plate 36 includes an upstanding flange 38 around the periphery of front plate 36. Flange 38 is attached to ridges 20 of cell 22 by a suitable attaching means such as a weld 40. Flange 38 is designed to be a snug fit in the top of cell 22 and is preferably made out of the same material as matrix block 12.

Figure 3:
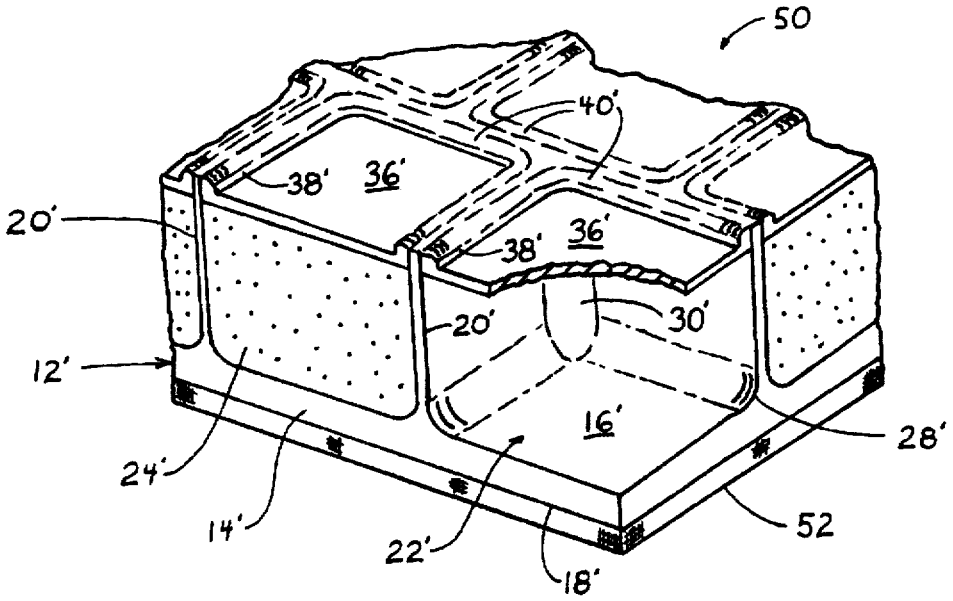
FIG. 3 is a cutaway perspective view of a modified armor according to the present invention.
Figure 4:
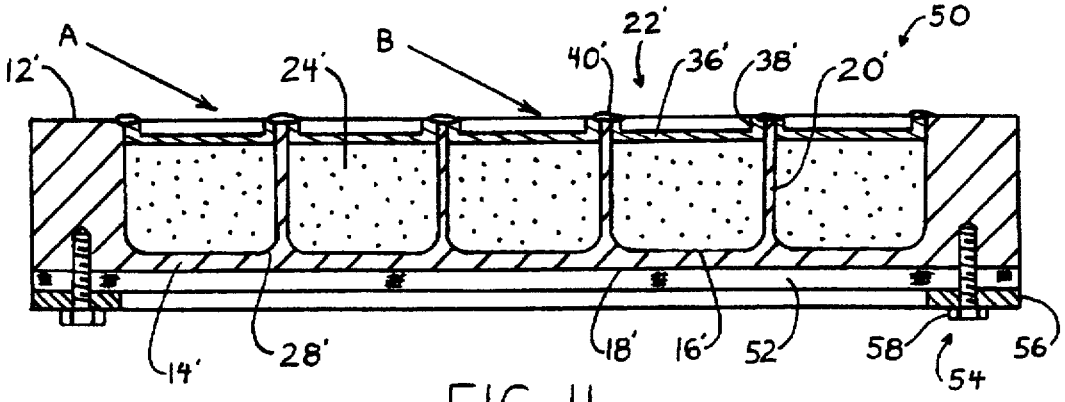
FIG. 4 is a cross-sectional side view of the modified form of the invention depicted in FIG. 3.

Depicted in FIGS. 3 and 4 is an alternative embodiment of a composite armor 50 according to the present invention. Composite armor 50 is similar to composite armor 10 and the similar elements of composite armor 50 have been identified with the same numerals used to identify the elements in composite armor 10 but with the addition of a "'" after the numeral. It should be appreciated that composite armor 50 does differ from composite armor 10 somewhat in that ceramic bodies 24' do not have a concave front surface 26 but rather have a flat front surface as shown. Front plates 36' are similarly flat shaped. The shape of ceramic bodies 24' and front plate 36' simplifies the construction of ceramic bodies 24' and front plate 36' compared to ceramic bodies 24 and front plate 36. However, the inducement of particles resulting from an impact to follow a path away from the front surface of armor 50 is not as great as when a concave front surface 26 is used.

Composite armor 50 also includes a momentum trap means 52 which is preferably a layer of flexible material such as a polymer impregnated woven fabric. A suitable impregnated woven fabric is a phenolic resin impregnated KEVLAR fabric. Momentum trap means 52 is attached to rear 18' of planar back 14' by a steel frame 56 and cap screws 58 received in matrix block 12' as shown. Momentum trap means 52 is designed to provide additional momentum loading capacity for composite armor 50. Momentum trap means 52 is especially effective in trapping spall ejected from rear 18' of planar back 14'.

Figure 5:
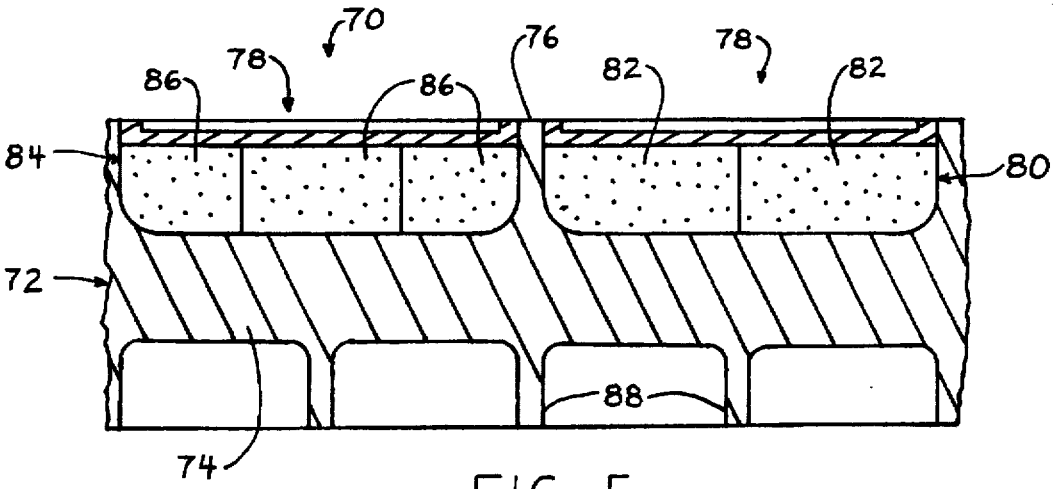
FIG. 5 is a cross-sectional side view of another modified form of the present invention.

Depicted in FIG. 5 is an alternative embodiment of a composite armor 70. Composite armor 70 includes a matrix block 72 having a planar back 74 and ridges 76 forming cells 78. In one cell 78, a ceramic body 80 is provided which comprises two mating ceramic blocks 82. In the other cell 78 depicted, a ceramic body 84 is provided which comprises three ceramic blocks 86. Ceramic bodies 80 and 84 are conveniently used where a single preformed ceramic body, such as ceramic body 24, is unavailable. In addition, a plurality of ceramic blocks can be used in some cases where improved performance results compared to a single preformed ceramic body. It should be appreciated that the mating blocks can have their mating surfaces at any orientation such as horizontal or at a slanted angle instead of the vertical mating surfaces depicted.

In this embodiment of the present invention, planar back 74 of composite armor 70 has an increased stiffness provided by ridges 88 protruding from the rear of planar back 74. It should be appreciated that the increased stiffness of ridges 88 can be provided with no change in the areal density of composite armor 70 relative to a composite armor without ridges 88. In order to accomplish this, the thickness of planar block 74 is decreased by the amount of material needed to create ridges 88. This redistribution of the material increases the moment of inertia of the cross section at intervals across the plane of planar back 74 in a manner similar to a honeycomb structure.

The stiffness of planar back 74 is important because if planar back 74 lacks sufficient stiffness, planar back 74 may deflect easily under any applied momentum load so as to allow rapid displacement of ceramic block fragments. This displacement, which represents a loss of confinement of the ceramic block material, results in a reduction of the energy absorbing capability of the ceramic block. In addition, a lack of sufficient stiffness will also result in undesired deflection over a much wider area of armor 70 so that the performance of more than just the impacted area of cell 78 is affected. It should also be appreciated that while the stiffening of planar back 74 is desirable, planar back 74 must still retain some energy absorption capability of its own. Therefore, the amount of material used to form ridges 88 must not be so great as to leave the remaining portion of planar back 74 too thin.

According to the armor design of the present invention, a multi-layer type is provided with a ceramic material constituting an intermediate layer confined between front and back plates made of metal. Fabrication is designed to be accomplished by conventional machining and forming techniques.

It should also be appreciated that, relative to an armor design containing a large continuous ceramic core material, the cells of the present invention subdivide the ceramic core material into separate compartments. Thus, when a specific cell is hit, only the ceramic material in that cell is subject to the full effects of the projectile kinetic energy. The lateral extent of damage is thereby limited as any metal deformation occurs locally, and nearby cells retain much of their original energy absorbing capability. While the cells of the present invention have been depicted as being square or rectangular in shape, it should be appreciated that any practical shape which allows uniform distribution across the surface is possible. Thus, such shapes as circles, triangles, hexagons, and octagons could be used, both in place of regular rectangular cells or in combination with such cells. Where rectangular or triangular cells are used, such cells can be either in the staggered row configuration depicted in FIG. 1 or in unstaggered rows and columns.

It should still further be appreciated that each cell has an individual front plate which provides frontal confinement for the ceramic body underneath. Because each front plate is separate and retained at the edges, each front plate reacts to an impact independently. Thus, the lateral spread of a front plate damage is limited. In contrast, a continuous front plate covering many cells can peel away as a result of a single impact and thus seriously reduce the ceramic body confinement of many cells.

It should further be appreciated that the ceramic body is designed with a sufficient thickness to contain a major portion of any projectile kinetic energy. As mentioned above, the performance of a ceramic body is degraded if the fit of the body within a cell is too loose. However, the tolerances necessary to retain satisfactory performance of a ceramic body should be easily met by routine fabrication methods. In addition, as mentioned above, the fit and hence the performance can be improved if gaps are filled with a ceramic-based grout. If a grout is used, the grout must also be able to withstand any local heating that occurs when the front plates are welded in place.

The planar back of the present invention is designed to be the main structural element of the armor of the present invention. In addition, in the event that the ceramic body is fully penetrated, the planar back also provides additional energy absorbing capacity. It should be appreciated that the ridges provided on the front of the planar back also stiffen the planar back as well as holding the front plate to the planar back.

The use of fillets as described above is also designed to reduce stress concentrations. Since the juncture of the ridges and planar back as well as the juncture of the ridges are the points which are highly loaded when the armor is impacted, it is important that these points be as strong as possible and resistant to failure by shear. Properly designed fillets provide this needed strength.

The flange provided on the front plate is preferably machined on so as to provide additional in-plane stiffening as well as a supporting surface for the welded attachment to the ridges. The welding of the flanges to the ridges is also designed to promote breakaway of an impacted plate while providing sufficient strength to limit damage to adjacent cells.

In order to evaluate the performance of the armor designs described above, a number of tests were performed. Specific armors according to the present invention were designed to meet a variety of situations that could be encountered in practice. These situations are characterized in terms of the type of threat to be encountered, requirement for structural function, and constraints imposed as to weight, thickness, material compatibility, and the spacing of multiple impacts. The results of these tests follow.

TEST 1

This experiment was designed to test a lightweight armor as protection against steel core bullets. Many combat vehicles currently utilize monolithic aluminum armor as an element in their structure to afford protection against typical threats of this type such as rifle or machine gun launched armor piercing bullets. Such vehicles include a variety of naval vessels, amphibious landing craft, and armored troop carriers. Armored portions include hulls, superstructures, turrets, and protective skirts.

A typical combat situation involves the need to defend against 12.7 mm, steel core, armor piercing bullets. The most severe test of an armor against this type of threat is characterized by an impact at muzzle velocity (about 0.82 km/sec) and normal (0°) obliquity. Under these conditions, monolithic aluminum armor approximately 83 mm thick and weighing 220 kg/m$^2$ is required to provide adequate protection. In a test for this type of situation, a composite armor as depicted in FIGS. 1 and 2 was tested. The cells had a 61 mm length and width, a 16.5 mm thickness at the center, ridges which were 3.2 mm thick, and 6 mm radius corners. The thickness of the front plate at the center was 6.9 mm while the thickness of the planar back was 23 mm. The radius of the concave surface of the ceramic body was 76 mm and the heighth of the flange above the front plate was 3.2 mm. This composite armor had a weight of 146 kg/m$^2$, which is only 67% of the weight of the monolithic aluminum required to defeat this same threat. The matrix block was formed of an aluminum alloy (6061-T651) and the ceramic bodies were formed of alumina ceramic (SC-98D manufactured by Centerflex Technologies Inc.).

Ballistics tests were conducted in which this armor was struck six times with 12.7 mm Soviet B32 steel core bullets. Five of the cells were struck at greater than muzzle velocity (0.825 km/sec and higher) and all of these cells succeeded in stopping the bullet. A sixth impact struck a ridge and the bullet perforated the armor at slightly below muzzle velocity. The spacing between all of these impacts was approximately five bullet diameters, a multiple impact criterion frequently applied in judging armor performance. With the exception of the single failure in a location where performance was expected to be somewhat below nominal, this armor successfully sustained five impacts within an area of 60 cm$^2$ under conditions that exceeded the most severe to be encountered in practice with this projectile.

This test demonstrated that an armor as described above can provide protection against penetration by multiple impacts of steel core, armor piercing bullets for an armor weight that is only 67% of that required with monolithic aluminum armor.

TEST 2

Combat vehicles of the type described above may also be subject to encounter with a more severe threat such as the Soviet tungsten carbide core, 14.5 mm, BS41 armor piercing bullet. Because of the extreme hardness of the core of this bullet, it can defeat a ceramic composite armor utilizing alumina such as that described above unless a substantially greater weight is expended in ceramic. For this reason, a harder ceramic, a hot-pressed silicon carbide ceramic, was used in place of the alumina ceramic described above.

In order to defeat a projectile such as the BS41 at its muzzle velocity of 1.00 km/sec and 0° obliquity, approximately 47 mm of monolithic steel armor weighing 366 kg/m$^2$ or 130 mm of monolithic aluminum armor weighing 347 kg/m$^2$ is required.

The test armor according to the present invention is similar to that depicted in FIG. 3, but without the momentum trap means at the back. In particular, the ceramic body did not have a concave front surface similar to the armor depicted in FIG. 2. The cell of this armor had a width and length of 74.7 mm, a thickness of 30.6 mm, and rounded edges of 6 mm radius. The thickness of the front plate was 3.99 mm with a total height of the plate being 5.0 mm. The thickness of the planar back was 22.7 mm so that the armor had a total height of 58.4 mm. The flange of the front plate had a thickness of 3.18 mm and the thickness of the ridges was 4.78 mm. As mentioned above, the ceramic body was a hot-pressed silicon carbide (Ceralloy 146 IG manufactured by Ceradyne Inc.) and the matrix block was made from an aluminum alloy (6061-T651). This armor had an areal density of 166 kg/m$^2$, only 48% of the weight of the required monolithic aluminum armor.

Ballistic tests were conducted on this armor in which 14.5 mm, tungsten carbide core bullets equivalent to the Soviet BS41 were used. The armor was struck twice at 0° obliquity at velocities slightly below muzzle velocity and the projectile was defeated in both instances. The impact velocity used corresponded to a range of about 100 meters, a range at which the required monolithic armor is only slightly lighter than that required at point-blank range (muzzle velocity).

Thus, it was demonstrated that an armor designed according to the present invention was capable of defeating multiple impacts of a 14.5 mm, tungsten carbide core bullet of the BS41 type at a weight approximately one-half that of the required monolithic aluminum armor.

TEST 3

In some cases, the need to armor a portion of a combat vehicle may not permit the complete replacement of an existing structural plate or element. This can be true especially when the existing structure also serves an armor function but is found to be inadequate against improved threats. In such cases, one solution is the addition of a supplemental armor layer or appliqué in front of the existing armor. Usually the addition of appliqué adds unwanted weight to the vehicle,, so it is of utmost importance that appliqué weights be kept to a minimum. A ceramic composite armor designed according to the present invention is ideal for this purpose.

The armor tested was designed as a supplement to the monolithic aluminum armor used on the lower glacis of the U.S. Bradley fighting vehicle. The lower glacis as built consists of 52 mm of 7039 aluminum at a minimum obliquity of 45° to the expected line of fire. Against an advanced threat such as the U.S. heavy metal core M-791, this armor by itself is inadequate. The M-791 can penetrate over 51 mm of steel armor or approximately 145 mm of aluminum armor at 45° and a muzzle velocity of 1.45 km/sec.

The basic design of the appliqué tested is similar to that disclosed in FIG. 3 but without the momentum trap means. The cells used were rectangular having a width of 76 mm and a length of 108 mm. The thickness of the ceramic block was 27.9 mm with 6 mm radius corners. The thickness of the front plate was 2.5 mm while the thickness of the planar back was 22.9 mm. The thickness of the ridges was 4.8 mm along the width direction between the cells and 6 mm along the length direction of the cells. The total thickness of the armor was 57.2 mm. The matrix block was made of cast A357 aluminum alloy and the ceramic core was 146IG hot-pressed silicon carbide. The appliqué design weighed 158 kg/m$^2$ while the 52 mm of 7039 aluminum glacis armor weighs 142 kg/m$^2$. The total areal density for the combination is 300 kg/m$^2$. Relative to 51 mm of steel weighing 408 kg/m$^2$, there is a weight savings of 26%. Relative to 145 mm of aluminum weighing 391 kg/m$^2$, the savings is 23%.

Tests of the armor described above were conducted in which four M-791 projectiles struck the target at velocities of 1.47 km/sec and 45° obliquity. In all cases, the combination of the appliqué armor of the present invention and 52 mm of base aluminum armor stopped the projectile. Penetration of the base armor proceeded to between 15 and 30% of its thickness. All four impacts occurred within an area of less than 450 cm$^2$ of the armor surface. These tests successfully demonstrated the use of a system according to the invention as a lightweight appliqué to supplement existing monolithic aluminum armor.

TEST 4

Heavy armor is typified by thick steel plates used for portions of tank bodies and large gun turrets. Because of the magnitude of the threats involved, extremely thick steel plates are required. For example, the U.S. M-774, heavy metal, long rod projectile can penetrate approximately 200 mm of rolled homogenous steel armor at 60° obliquity and 1.50 km/sec velocity. This armor weighs 1565 kg/m$^2$. The very large fraction of a vehicle's total weight devoted to such armor places an extreme limitation on performance expectations. Therefore, it is highly desirable to seek ways of reducing the weight of the armor without reducing the level of protection.

Moreover, since more advanced threats can defeat the armor some existing vehicles, retrofit to replace monolithic armor with ceramic composite armor of equal weight but increased level of protection according to the present invention should be considered. In both approaches, ceramic composite armor systems according to the present invention had been shown to effective.

Because of the great expense that would be involved in testing full size specimens of this type, much of the research and develop work done on heavy armor is done at subscale, usually one-quarter of full size. For this reason, the tests described below were similarly done at this reduced scale. There is considerable evidence that results acquired in such one-quarter scale tests are valid for full-scale purposes.

The composite armor tested according to the present invention was similar to that depicted in FIG. 4 and included the momentum trap means provided at the back of the planar back. The ceramic body had a square cross section of 45 mm and a height of 33.5 mm. The thickness of the front plate was 2.5 mm while the thickness of the planar back was 5.1 mm. The total height of the armor, exclusive of the momentum trap means, was 45.9 mm. The thickness of the momentum trap means was 8.0 mm, and the thickness of the ridges was 3.2 mm. The matrix block and front plates were made of 4340 steel alloy heat treated to a Brinell hardness number of 300. The ceramic bodies were formed of a hot-pressed silicon carbide ceramic (146 IG). The momentum trap means was a phenolic resin impregnated KEVLAR fabric. The weight of this armor is 208 kg/m$^2$, or only 52% of a required steel armor.

The test condition for this armor simulated conditions which might be encountered by the glacis or turret of a battle tank in combat. The projectile was a long rod having a fineness ratio of 10 and a weight of 65 gm. It was made of a depleted uranium (DU) alloy. The impact occurred at a velocity of approximately 1.52 km/sec at 60° obliquity. Under these conditions, this projectile can penetrate 51 mm of rolled homogenous steel armor weighing 397 kg/m$^2$.

The armor described above was struck twice by the DU long rod projectiles described above at the locations indicated by arrows A and B in FIG. 4. These impact points were chosen so that each trajectory passed through the center of mass of the corresponding ceramic body. The impact velocities were 1.51 and 1.48 km/sec, respectively. The spacing of the impact trajectors was less than 6 projectile diameters.

In both cases, the armor succeeded in stopping the projectile. Thus, it was demonstrated that a specimen target of a ceramic composite armor system designed according to the present invention can provide projectile protection against multiple impacts of a heavy metal, high fineness-ratio projectile for a weight per unit area (areal density) of approximately one-half that of the necessary monolithic steel armor.

TEST 5

In terms of penetrating capability against monolithic metal armor, the jet of a shaped charged warhead can exceed that of other weapon systems of comparable scale. The extremely heavy weight of monolithic armor required in combat vehicles to provide protection against such jets suggests that lighter alternatives are desired. For this reason, a ceramic composite armor according to the present invention was tested against shaped charges of this type. The tested armor was intended to provide protection against multiple impacts of the jet from a 28 mm diameter shaped charge at 60° obliquity. Such a charge is capable of penetrating 155 mm of rolled homogeneous steel armor. For impacts at 60° obliquity, the required armor weighed 606 $kg/m^2$. For the armor described below, the weight was 262 $kg/m^2$ representing a weight savings of 57%. The shaped charge and target tested were approximately one-fifth the size of a full-scale weapon and armor.

The ceramic armor tested according to the present invention was similar to that depicted in FIG. 4. Square cross-sectioned ceramic blocks having a width of 119 mm and a thickness of 48.1 mm were used. The front plates had a thickness of 1.9 mm while the planar back had a thickness of 9.8 mm. The thickness of the ridges was 4.8 mm. The total thickness of the armor without the momentum trap means was 64.3 mm while the thickness of the momentum trap means was 7.4 mm. In this test, the ceramic bodies to be impacted were made of a hot-pressed silicon carbide (146IG) while the remaining ceramic bodies were made of sintered aluminum oxide (SC-98D). The limited use of hot-pressed silicon carbide ceramic bodies was based on the consideration of the relative cost of the two ceramics. The matrix block and front plates were made of 4340 steel alloy heat treated to a Brinell hardness of 300. The momentum trap means was a KEVLAR backup layer such as described above.

The above armor design was struck by a jet from a 28 mm shaped charge device at each of the hot-pressed silicon carbide ceramic bodies. The jet was directed at 60° obliquity toward the center of each ceramic body. The nominal jet velocity was 8.5 km/sec and the spacing of the two impact points was equivalent to three times the bore diameter of a hypothetical launcher for the 28 mm device.

In both cases, the penetration of the jet was stopped at a point at the interface between the ceramic body and the planar back. On the basis of this and other related tests, it is evident that a ceramic composite armor system according to the present invention can be effective in protecting against multiple impacts of a shaped charged jet for a weight that is less than one-half that of a required monolithic steel armor.

As all of the above tests indicate, the design of successful ceramic composite armors according to the present invention can be modified to meet a variety of situations that may be encountered in practice. Thus, while the present invention has been described with respect to exemplary embodiments thereof, it will be understood by those of ordinary skill in the art that variations and modifications can be effected within the scope and spirit of the invention.

We claim:

1. A lightweight composite armor comprising:

an integrally formed matrix block including a generally planar back and a plurality of intersecting ridges extending from a front side of said planar back and terminating in a top, said intersecting ridges forming a pattern of open-topped cells;

an energy absorbing ceramic body located in each cell which serves as a primary energy-absorbent of the armor as each said ceramic body is maintained in the associated cell, each said ceramic body being located below the tops of the surrounding ridges;

individual front plates sized to close only the open top of each associated cell, each said front plate being in mating contact with an associated said ceramic body and including at least a lower portion located below the tops of the surrounding ridges of the associated cell; and an attaching means for attaching each said front plate to the tops of adjacent said ridges of the cells around the periphery of said plates whereby impact by a projectile on one said front plate substantially limits any damage to that one said front plate and the underlying ceramic body leaving the remaining armor substantially undamaged.

2. A composite armor as claimed in claim 1 wherein said ceramic body is integrally formed.

3. A composite armor as claimed in claim 1 wherein said ceramic body comprises at least two pieces, each said piece being larger than the projectile.

4. A composite armor as claimed in claim 1 wherein said ceramic body is made of an alumina ceramic.

5. A composite armor as claimed in claim 1 wherein said ceramic body is made of a hot-pressed silicon carbide ceramic.

6. A composite armor as claimed in claim 1 and further including fillets provided at the junctures between said planar back and said ridges.

7. A composite armor as claimed in claim 6 and further including fillets provided at the junctures between said ridges.

8. A composite armor as claimed in claim 1 wherein said front plates include an upstanding flange around the periphery thereof, and wherein said attaching means attaches said flanges of said front plates to said ridges.

9. A composite armor as claimed in claim 1 wherein said attaching means is a weld.

10. A composite armor as claimed in claim 1 wherein small gaps exist between the cells and said ceramic bodies located therein, and further including a ceramic-based grout located in these gaps to fill these gaps.

11. A composite armor as claimed in claim 1 wherein said matrix block and said front plate are formed of an aluminum alloy.

12. A composite armor as claimed in claim 1 wherein said matrix block and said front plate are formed of a hard steel alloy.

13. A composite armor as claimed in claim 1 and further including a momentum trap means attached to a rear side of said planar back for trapping spall ejected from said planar back as a result of a projectile impact on the armor.

14. A composite armor as claimed in claim 13 wherein said momentum trap means is a layer of a flexible material.

15. A composite armor as claimed in claim 14 wherein said flexible material is a polymer impregnated woven fabric.

16. A composite armor as claimed in claim 1 and further including stiffening ridges extending from a rear side of said planar back.

17. A composite armor as claimed in claim 1 wherein each said ceramic body includes a recessed surface adjacent the mating said front plate which induces particles resulting from an impact to follow a path away from said front plate to localize any damage to the area of the associated cell.

18. A composite armor as claimed in claim 17 wherein said recessed surface is concave shaped.

19. A lightweight composite armor comprising:

an integrally formed matrix block including a generally planar back having a front and a rear, a plurality of intersecting ridges extending from the front of said planar back and terminating in a top, and fillets provided at the junctures between said planar back and said ridges and at the junctures between said ridges, said planar back and said ridges forming a pattern of open-topped cells;

an energy absorbing ceramic body located in each cell which serves as a primary energy-absorbent of the armor as each said ceramic body is maintained in the associated cell, said ceramic body extending from said planar back to a position below the tops of adjacent said ridges in each cell;

individual front plates sized to fit only in the open top of each associated cell in mating contact with said ceramic body, said front plates including a planar portion located below the tops of the surrounding ridges and an upstanding flange around the periphery thereof; and a weld around the periphery of said front plates between said flanges of said front plates and the associated tops of said ridges such that said front plates are individually attached to said matrix block and whereby impact by a projectile on one of said front plates substantially limits any damage to that one said front plate and the underlying ceramic body leaving the remaining armor substantially undamaged.

20. A composite armor as claimed in claim 19 wherein each said ceramic body includes a concave surface adjacent the mating said front plate which induces particles resulting from an impact to follow a path away from said front plate to localize any damage to the area of the associated cell.

21. A composite armor as claimed in claim 20 wherein small gaps exist between the cells and said ceramic bodies located therein, and further including a ceramic-based grout located in these gaps to fill these gaps.

* * * * *